US007778588B2

(12) United States Patent
Okazaki

(10) Patent No.: US 7,778,588 B2
(45) Date of Patent: Aug. 17, 2010

(54) SHEET FEEDING APPARATUS AND IMAGE FORMING APPARATUS

(75) Inventor: Shigeru Okazaki, Musashimurayama (JP)

(73) Assignee: Konica Minolta Business Technologies, Inc. (JP)

( * ) Notice: Subject to any disclaimer, the term of this patent is extended or adjusted under 35 U.S.C. 154(b) by 704 days.

(21) Appl. No.: 11/635,424

(22) Filed: Dec. 7, 2006

(65) Prior Publication Data

US 2007/0201919 A1 Aug. 30, 2007

(30) Foreign Application Priority Data

Feb. 27, 2006 (JP) ..... 2006-049904

(51) Int. Cl.
*G03G 15/00* (2006.01)
*B41F 35/00* (2006.01)

(52) U.S. Cl. ..... 399/388; 399/390; 101/423

(58) Field of Classification Search ..... 399/388, 399/390

See application file for complete search history.

(56) References Cited

U.S. PATENT DOCUMENTS

2001/0023646 A1* 9/2001 Takata ..... 101/425
2002/0163568 A1* 11/2002 Takeishi ..... 347/101
2003/0030712 A1* 2/2003 Kawaguchi et al. ..... 347/104

FOREIGN PATENT DOCUMENTS

| | | | |
|---|---|---|---|
| JP | 8-314344 | | 11/1996 |
| JP | 11-52641 | | 2/1999 |
| JP | 11-208918 | | 8/1999 |
| JP | 2003081478 | A * | 3/2003 |
| JP | 2004-224451 | | 8/2004 |
| JP | 2004224451 | A * | 8/2004 |

* cited by examiner

*Primary Examiner*—Ren Yan
*Assistant Examiner*—Allister Primo
(74) *Attorney, Agent, or Firm*—Cantor Colburn LLP

(57) ABSTRACT

A sheet feeding apparatus, having: a first sheet feeding member to press a top surface of a sheet for sending out a sheet stored in a sheet storing section; a second sheet feeding member arranged on a downstream side of the first sheet feeding member with respect to a sheet feeding direction to further convey the sheet from the first sheet feeding member downstream; and a first cleaning member rotatably supported in contact with a circumference surface of the first feeding member and a circumference surface of the second feeding member to cleaning a circumference surface of the first feeding member and a circumference surface of the second feeding member by rotation.

5 Claims, 4 Drawing Sheets

SHEET FEEDING APPARATUS AND IMAGE FORMING APPARATUS

This application is based on Japanese Patent Application No. 2006-049904 filed on Feb. 27, 2006 in Japanese Patent Office, the entire content of which is hereby incorporated by reference.

BACKGROUND OF THE INVENTION

The present invention relates to a sheet feeding apparatus used for an image forming apparatus such as a copying machine, a printer, a facsimile machine and a multi function machine having the functions thereof, and in particular, to a sheet feeding apparatus provided with a cleaning member to remove foreign objects such as paper dust adhered on a circumference surface of a sheet feeding roller.

As a foreign object removing device for an image forming apparatus, a fixed type cleaning member (flexible member such as brush, felt and PET sheet) in contact with a roller member to convey a recording sheet is used so as to remove the foreign object such as the paper dust. Also, a cleaning roller (brush or felt) in contact with the recording sheet conveyed is used to remove the foreign object such as the paper dust.

For example, in Patent Document 1, as the foreign object removing device, there is used the fixed type cleaning member such as a felt in contact with a conveyance roller to clean a surface of the recording sheet through the conveyance roller.

In Patent Document 2, a bush in contacted with a cleaning roller which cleans the recording sheet is used to clean the cleaning roller.

In Patent Document 3, a method, wherein the cleaning roller is in contact with the recording sheet to be conveyed is used.

In Patent Document 4, the conveyance roller is cleaned by contacting a rotating brush roller to the conveyance roller, and the brush roller is cleaned by contacting a rotation roller, and then the rotation roller is cleaned by contacting a plastic sheet.

[Patent document 1] Japanese Patent Non-Examined Publication No. 11-52641

[Patent document 2] Japanese Patent Non-Examined Publication No. 11-208918

[Patent document 3] Japanese Patent Non-Examined Publication No. 8-314344

[Patent document 4] Japanese Patent Non-Examined Publication No. 2004-224451

When a printed sheet, in particular, a sheet printed by offset printing passes through a sheet feeding device or a sheet conveyance device arranged in an image forming apparatus and a finishing apparatus, sprinkled flour, ink residue and coating agent on the sheet surface adhere on a circumference surface of the sheet feeding roller and the conveyance roller and deteriorate a conveyance capacity of the sheet feeding roller and the conveyance roller and then sheet feeding performance becomes unstable. Thus cleaning of the conveyance roller becomes necessary.

However, in the foreign object removing devices such as the fixed type cleaning member in contact with the aforesaid sheet feeding roller and the conveyance roller to remove the foreign object, the cleaning roller such as the rotation brush in contact with a transfer material to be conveyed to remove the foreign object, and the cleaning roller in contact with the transfer material to be conveyed to remove the foreign object and in the image forming apparatus utilizing the device thereof, there is a problem that removing of the foreign object such as the paper dust cannot be carried out in a stable condition for long period of time, then entering of the foreign object into a transferring area can not be reduced for a long period of time.

In a reverse roller type sheet feeding roller method, a rising fabric such as a moquette, and a flexible member such as an urethane foam or a PET sheet are imposed onto the roller to remove the foreign object such as the paper dust adhered on rotation rollers such as a pick roller and the feeding roller. However, in the rising fabric and the flexible member, since scraped foreign object cannot be separated from the roller, cleaning effect cannot be sustained and cleaning members and rollers need to be cleaned or replaced periodically.

In the image forming apparatus of Patent Document 1, there is a problem in durability that the foreign object such as the paper dust is accumulated in the cleaning member in short time, then the paper dust exceeding a capacity of cleaning is conveyed to the transferring area.

In the image forming apparatus of Patent Document 2, there was a problem that conveyance of a transfer material is unstable because the cleaning roller is configured to have a speed difference for the transfer material.

In the image forming apparatus of Patent Document 3, there was a problem in durability that when the foreign object such as the paper dust is accumulated on the surface of the cleaning roller, cleaning becomes not effective.

In the image forming apparatus of Patent Document 4, it is necessary to select a material of the conveyance roller rubber and the cleaning member appropriately, otherwise stable sheet conveyance performance and high efficiency of cleaning cannot be obtained.

Also, the pickup roller has to convey the sheet to the feeding roller without fail and a pressure the pickup roller presses the sheet has to be loaded appropriately. To apply the appropriate load stably, it is effective that the pressure is imposed by the weight of the pickup roller and its holder. In this case, there is occurred a problem that appropriate load cannot be applied because a cleaning mechanism of the pickup roller becomes large size.

SUMMARY

The above object is achieved by the followings.

(1) A sheet feeding apparatus, having: a first sheet feeding member to press a surface of top sheet and to send out a sheet stored in a sheet storing section; a second sheet feeding member arranged on a downstream side to the first sheet feeding member in a sheet feeding direction to convey the sheet from the first sheet feeding member downstream further; and a first cleaning member rotatably supported in contact with a circumference surface of the first feeding member and a circumference surface of the second feeding member to cleaning a circumference surface of the first feeding member and a circumference surface of the second feeding member by rotation.

(2) An image forming apparatus having: a sheet feeding apparatus of (1) and an image forming section to form an image on the sheet fed from the sheet feeding apparatus thereof.

BRIEF DESCRIPTION OF THE DRAWINGS

FIG. 2 (*b*) is a cross-sectional view of sheet feeding apparatus when pickup roller 111 is lowered to contact with a top surface of sheet S.

FIG. 3 (*a*) is a characteristic diagram indicating changes of a friction coefficient of a circumference surface of a feeding roller according to number of sheet passing through.

FIG. 4 (*b*) is a cross-sectional view of the rotation driving mechanism.

DETAILED DESCRIPTION OF THE PREFERRED EMBODIMENT

Next, an image forming apparatus of the present invention is explained with reference to drawings.

<Image Forming Apparatus>

Figure 1:
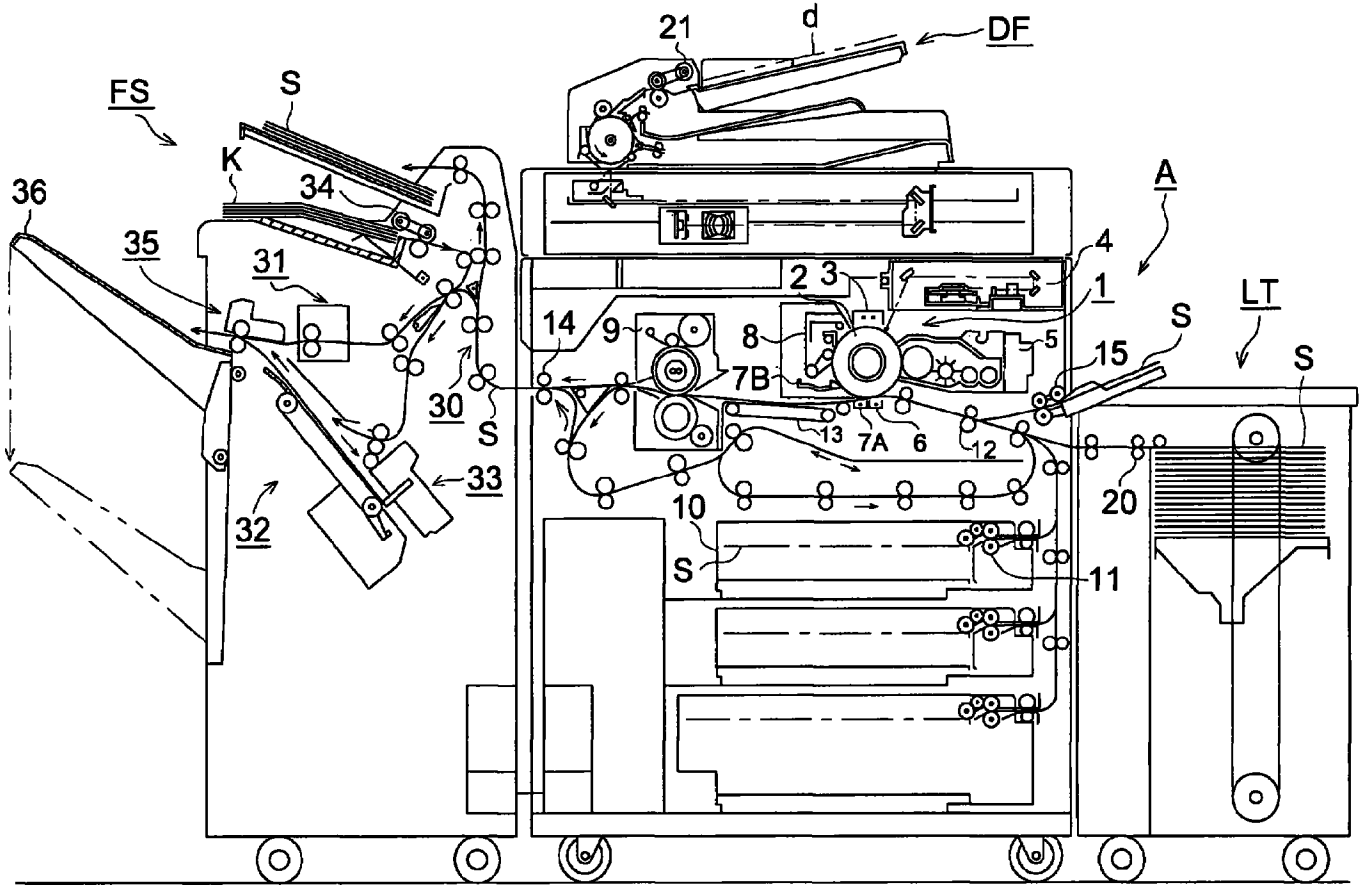
FIG. 1 is a configuration diagram of an image forming apparatus composed of an image forming apparatus main body, a finishing apparatus, a large capacity sheet feeding apparatus and an automatic document feeding apparatus.

FIG. 1 is a block diagram of an image forming apparatus composed of image forming apparatus main body A, finishing apparatus FS, large capacity sheet feeding apparatus LT and automatic document feeding apparatus DF.

Image forming apparatus main body A is provided with image forming section 1, fixing device 9, and a sheet conveyance system. Image forming section 1 is composed of charging device 3 arranged in vicinity of image carrier 2, image exposing device 4, developing device 5, transfer device 6, discharging device 7A, separation claw 7B and cleaning device 8.

Sheet conveyance system is composed of first conveyance section configured with sheet feeding cassette 10, first sheet feeding device 11, second sheet feeding device 12, conveyance device 13, sheet ejection device 14 and manual sheet feeding device 15, and a circulation sheet re-feeding section to circulate and feed the sheet again.

A plurality of sheet feeding devices (in the figure, three devices) are configured with sheet feeding cassette 10 and first sheet feeding device 11 to store and feed a plurality of sizes of sheets.

Sheet S conveyed from sheet feeding device 20 of large capacity sheet feeding apparatus LT is fed to second sheet feeding device 12.

Document d placed on the document table of automatic document feeding apparatus DF is conveyed by sheet feeding device 21 and a document image is read by an image reading device.

In image forming section 1, charging, exposing, developing, transferring, separating and cleaning processes are conducted. Transferring device 6 transfers an image on sheet S conveyed from sheet feeding cassette 10, manual sheet feeding device 15 or large capacity sheet feeding apparatus LT. Sheet S carrying the image is fixed by fixing device 9 and ejected from sheet ejection device 14 to be conveyed to finishing apparatus FS.

<Finishing Apparatus>

Finishing apparatus FS is composed of entrance convey section 30, shift unit 31, stacker unit 32, staple unit 33, coversheet feeding device 34 and sheet ejection device 35.

Cover sheet K fed from cover sheet feeding device 34 is conveyed by a conveyance roller group and stored in stacker unit 32. Coversheet K laps a plurality of sheets stored in stacker unit 32 to form a front cover and a back cover.

When a predetermined number of sheets S are loaded on stacker unit 32 and aligned, staple unit 33 staple sheet S at two positions or one position at a corner to saw sheets S.

Sheets S sewn are nipped and conveyed by sheet ejection device 35 and ejected onto main tray 36 to be piled up.

<Sheet Feeding Device>

Sheet feeding device is applicable to first sheet feeding device 11 and manual sheet feeding device 15 of sheet feeding cassette 10, sheet feeding device 20 of large capacity sheet feeding apparatus LT, sheet feeding device 21 of automatic document feeding apparatus DF and coversheet feeding device 34 of finishing apparatus FS which are arranged in image forming apparatus main body A.

Figure 2:
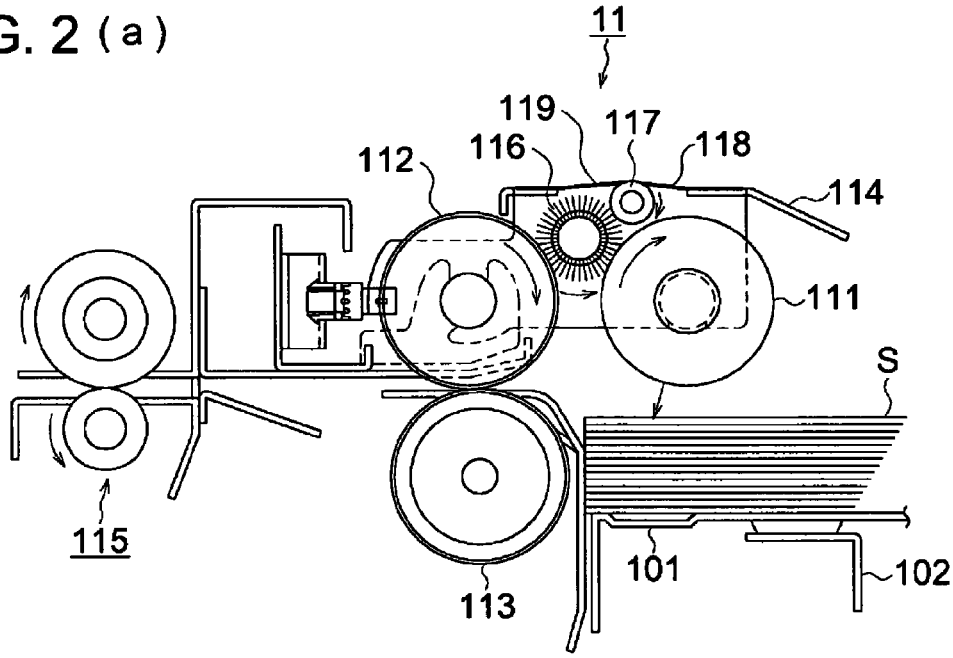
FIG. 2 (*a*) is a cross-sectional view of sheet feeding apparatus when pickup roller 111 is lifted.
Figure 2:
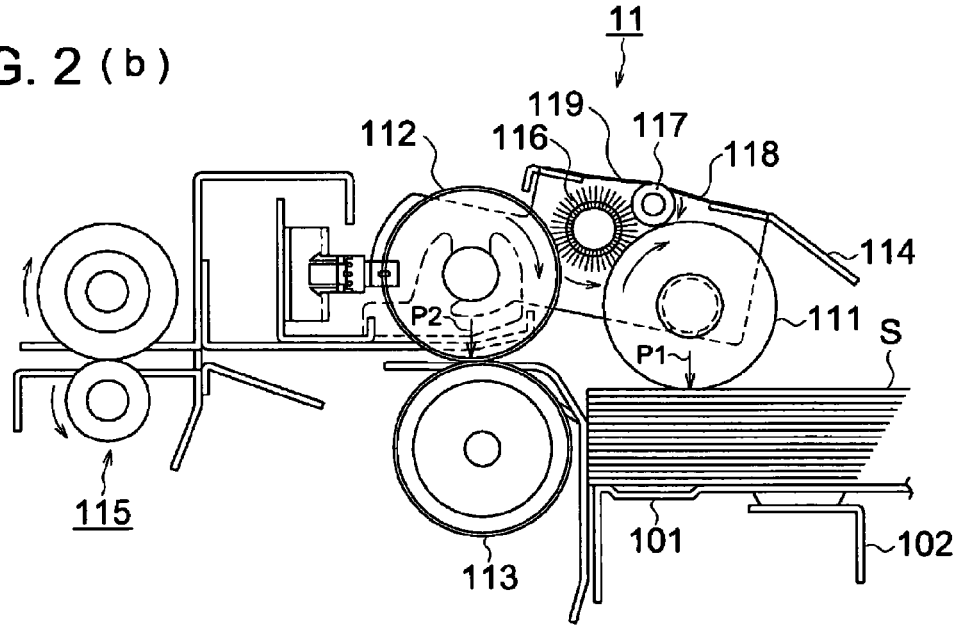

FIG. 2 is a cross-sectional view of sheet feeding apparatus. FIG. 2 (*a*) indicates a status before starting sheet feeding and FIG. 2 (*b*) indicates a status of sheet feeding.

Meanwhile, since manual sheet feeding device 15, sheet feeding device 20 of large capacity sheet feeding apparatus LT, sheet feeding device 21 of automatic document feeding apparatus DF and coversheet feeding device 34 of finishing apparatus FS have almost the same structure as first sheet feeding device 11, first sheet feeding device 11 is explained as a representative from here onward.

Sheet S loaded on hoisting bottom plate 101 in sheet feeding cassette 10 is lifted by an unillustrated motor through hoisting member 102 and when a top surface of sheet S reaches to a position to contacts with a circumference surface of pickup roller (first sheet feeding member) 111, an unillustrated sensor detects the top surface of sheet S to stop lifting of hoisting bottom plate 101.

At this sheet upper limit position, the top surface of sheet S is imposed by own weight of pickup roller 111 and holder 114 at a predetermined pressure P1.

Pickup roller 111 and sheet feeding roller (second sheet feeding member) 112 starts to rotate with a sheet feeding signal. Pickup roller 111 imposing the top surface of sheet S at the predetermined pressure P1 conveys sheet S to a nip area between sheet feeding roller 112 and multiple feeding preventing roller (reverse roller) 113, then pickup roller 111 is released from the surface of the sheet.

Multiple feeding preventing roller 113 is driven in a reverse direction of a conveyance direction of sheet S through an unillustrated torque limiter and imposed onto sheet feeding roller 112 by an unillustrated spring at a predetermined pressure.

When multiple feeding preventing roller 113 comes in contact directly with sheet feeding roller 112 because sheet S does not exist in the nip or when one piece of sheet S is fed into the nip area, the torque limiter slips beyond a limit torque and multiple feeding preventing roller 113 rotates along rotation of sheet feeding roller 112 to convey one piece of sheet S.

However, in case two pieces or more sheets s are conveyed into the nip area, the limit torque overcomes a friction force between the sheets and multiple feeding prevention roller 113 to rotate it in the reverse direction to push back sheets S under top sheet s to prevent multiple feeding and one piece of sheet S can be conveyed.

When a sheet feeding starting signal is inputted, pickup roller 111 swings centering on a rotation axis of sheet feeding roller 112, and comes to contact with the top surface of sheet S by its own weight. At the same time, electric clutch CL described later is engaged and sheet feeding roller 112 starts to rotate, and then pickup roller 111 starts to rotate through a driving power transmission device described later.

Sheet S is sent out by rotation of pickup roller 115, conveyed to the nip area where sheet feeding roller 112 and multiple feeding prevention roller 113 are imposed each other, and separated piece by piece. Then sheet S reaches to a pair of conveyance rollers 115 at downstream side in the conveyance direction.

When an unillustrated sensor detects arrival of sheet S at pair of conveyance roller 115, electric clutch CL is disengaged, then by pinching conveyance of pair of conveyance roller 115, sheet S is withdrawn from the nip area where sheet feeding roller 112 and multiple feeding prevention roller 115 are imposed each other and conveyed.

<Cleaning Member>

In fist sheet feeding device 11, first cleaning member (hereinafter called cleaning brush) 116, second cleaning member 117, third cleaning member 118 and shielding member 119 are arranged above a space where pickup roller 111 and sheet feeding roller 112 oppose each other.

Cleaning brush 116 rotate while contacting with a circumference surface of pickup roller 111 and a circumference surface of sheet feeding roller 112. Cleaning brush 116 is rotated in an anticlockwise direction shown by the figure through the driving device described later. Cleaning brush 116 and pickup roller 111 rotate in the same direction with a speed difference at a contact area.

Cleaning brush 116 scrapes pickup roller 111 and sheet feeding roller 112 to removes the paper dust and the foreign object.

Specification of Cleaning Brush 116

Bristle

| | |
|---|---|
| Material | Conductive acryl |
| Thickness | 6.25 denier (1 denier means a thickness of fiber where 450 m in length and 50 mg in weight) |
| Density | 100,000 pcs./25.4 $mm^2$ |
| Outer Diameter | 16 mm |
| Length | 4 mm |

Overlap

| | |
|---|---|
| Between pickup roller 111 and cleaning brush 116 | 0.5 to 1.5 mm |
| Between feeding roller 112 and cleaning brush 116 | 0.5 to 1.5 mm |

Second cleaning member 117 is a rotation roller driven by a drive device to rub cleaning brush 116. Second cleaning member 117 removes the paper dust and the foreign object adhering on cleaning brush 116.

Third cleaning member 118 is formed by a flexible thin plate such as PET (polyethylene terephthalate) to be in contact with a circumference surface of second cleaning member 117. An edge section of third cleaning member 118 imposes the circumference surface of second cleaning member 117 in a counter direction of a rotation direction of second cleaning member 117. Third cleaning member 118 removes the paper dust and the foreign object adhering on second cleaning member 117 and shields a space above pickup roller 111.

Shielding member 119 is a thin flexible plate arranged in a symmetrical position to third cleaning being in contact with the circumference surface of second cleaning member 117 member 118, and formed by, for example, PET (polyethylene terephthalate) or urethane sheet. The edge section of shield member 119 lightly imposes the circumference surface of second cleaning member 117 in a trailing direction. Shield member 119 removes the paper dust and the foreign object adhering on second cleaning member 117 and shields a space above sheet feeding roller 112.

In first sheet feeding device 11, when sheet S failed to be conveyed is removed, pickup roller 111 is lifted and swings upward centering on a sheet feeding roller axis. At this stage, since the space above cleaning brush 116 is shielded by third cleaning member 118 and shield member 119, the paper dust and the foreign objects around second cleaning member 117 are prevented from exsorption.

In case a brush of a cleaning member to clean a surface of a rubber feeding roller by scraping a rubber feeding roller is not conductive, there is occurred a problem that the surface of the robber feeding roller is charged then the paper dust and the foreign object adhering on the rubber feeding roller cannot be removed easily and a failure of image transferring in the transfer section of image forming apparatus A is caused. Therefore the brush for cleaning is preferred to have conductivity.

The cleaning brush 116 to clean pickup roller 111 and sheet feeding roller 112 is particularly needed to be small. However, there is a limit in size. A metal core to wind a rising brush has to have an outer diameter of at least 6 mm for strength and the outer diameter of 8 mm is preferred to perform a stable cleaning function.

Regarding the bristle of cleaning brush 116, a length of not less that 3 mm is needed. Thus combining the metal core and the length of the bristle, the outer diameter of cleaning brush 116 has to be not less than 14 mm.

Figure 3:
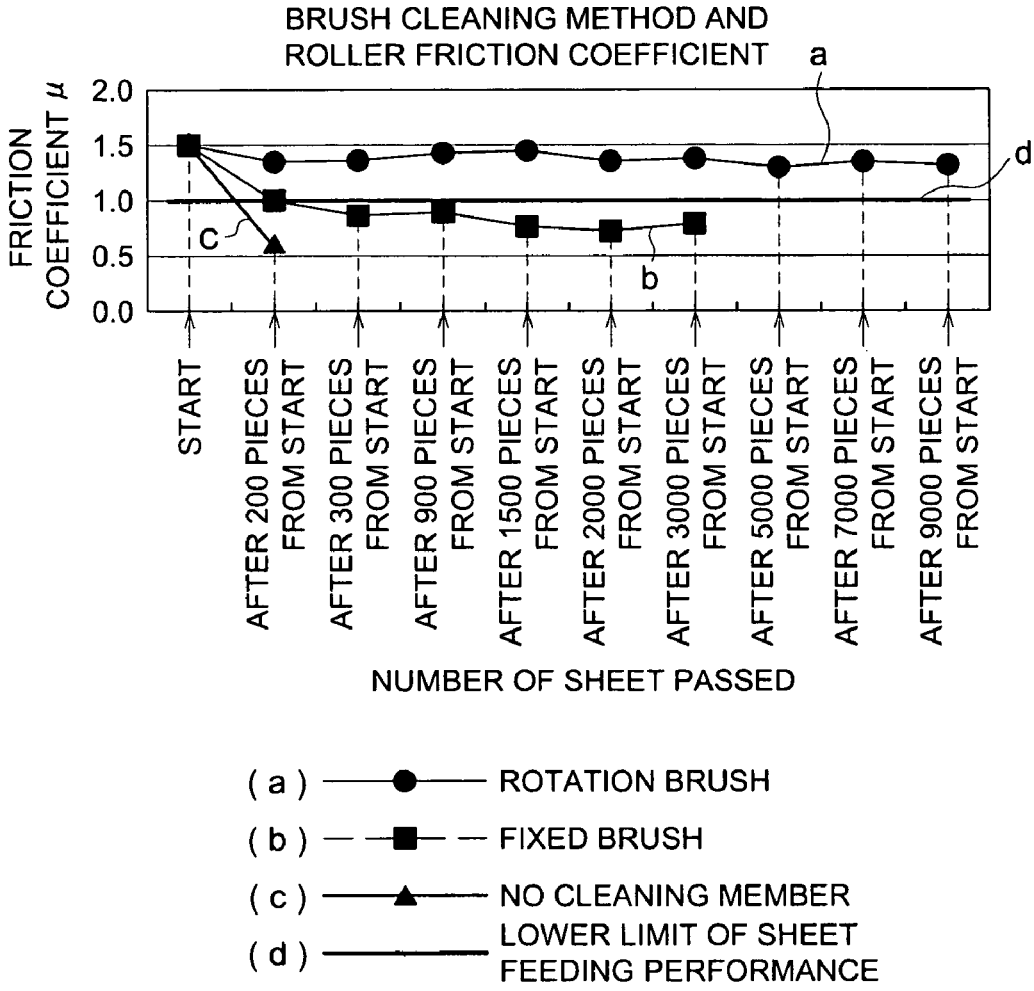

FIG. 3 is a characteristic diagram indicating a measurement result of change in a friction coefficient of the circumference surface of pickup roller 111 and sheet feeding roller 112 in accordance with the number of sheet passed.

As cleaning methods, (a) rotation brush, (b) fixed brush, and (c) no cleaning member are compared. (d) indicates lower limit of feeding performance.

In a condition where a roller surface is tainted by sprinkled powder, paper dust, and ink residue, a higher friction coefficient μ can be obtained as a surface roughness Rz (an average roughness of 10 points) increases.

Generally, pickup roller 111 and sheet feeding roller 112 coated by EDPM rubber having a high friction coefficient have a high performance of sheet conveyance at initial stage of printing, however in case sheet S printed by offset printing is conveyed, the sprinkled power, the paper dust and the ink residue adhering on sheet S before conveyance are transferred onto the roller surface and become difficult to be removed, thus the durability of sheet conveyance decreases. This is because EDPM rubber having the high friction coefficient has a characteristic that the sprinkled powder, the paper dust and the ink residue are easily adhered.

(a) In the rotation bush method, cleaning brush 116 can maintain a stable friction coefficient up to 9000 pieces of consecutive sheet conveyance.

(b) In the fixed brush method, at approximately 200 pieces of consecutive sheet conveyance from the beginning of conveyance, the friction coefficient μ rapidly decrease to the lower limit of sheet conveyance performance and if consecutive sheet conveyance is further continued, the friction coefficient becomes lower than the lower limit of sheet conveyance performance and a failure of sheet conveyance occurs.

(c) In the non cleaning member method, at approximately 100 pieces of consecutive sheet conveyance from the beginning of conveyance, the friction coefficient μ rapidly decrease to the lower limit of sheet conveyance performance and if consecutive sheet conveyance is further continued up to another 100 pieces, the friction coefficient decreases further and a failure of sheet conveyance occurs.

Cleaning brush 116 to rotate comes in contact with the circumference surface of sheet feeding roller 112 and the circumference surface of pickup roller 111 and cleans them at the same time. Also, cleaning brush 116 is refreshed by second cleaning member 117 an then second cleaning member 117 is further cleaned by third cleaning member 118 without fail.

<Rotation Driving Mechanism of Cleaning Brush>

Figure 4:
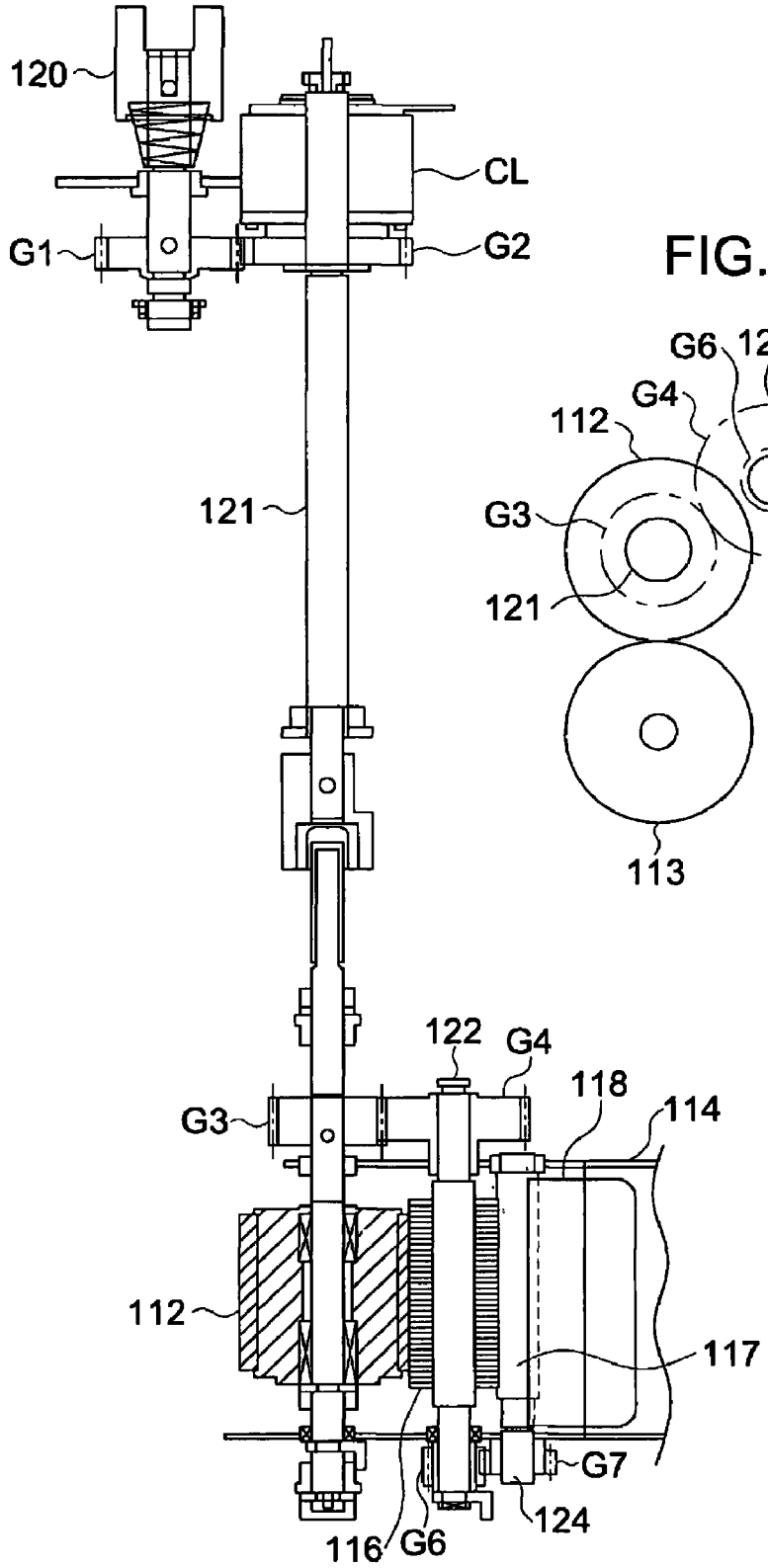
FIG. 4 (*a*) is a plane cross-sectional view of a rotation driving mechanism.
Figure 4:
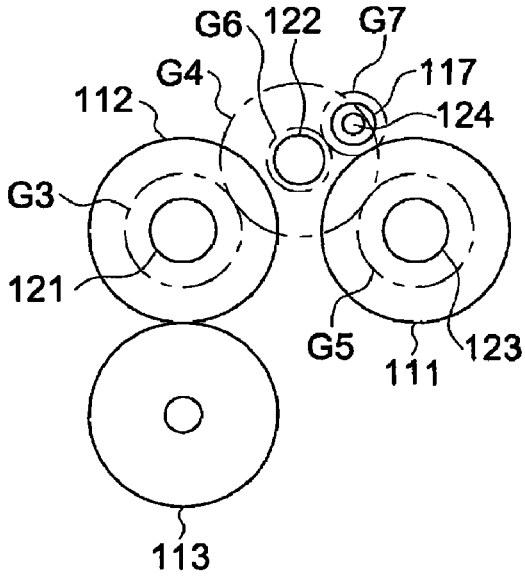

FIG. 4 (*a*) is a top view showing a rotation driving mechanism of cleaning brush 116 and FIG. 4 (*b*) is a side view of it.

An unillustrated driving source is connected with coupling 120 to rotate gear G1 continuously. Gear G1 is engaged with gear G2 to rotate rotation axis 121. Electric clutch CL arranged at an end of rotation axis 121 to connect and disconnect rotation driving force.

When clutch CL is engaged, rotation axis 121 rotates and sheet feeding roller 112 rotates in a clockwise direction shown by the figure. Second gear G3 fixed onto rotation axis 121 of sheet feeding roller 112 rotates first gear G5 fixed onto an end of rotation axis 123 of pickup roller 111 through intermediate gear G4. Thus both sheet feeding roller 112 and pickup roller 111 rotate in the clockwise direction as FIG. 4 (*b*) shows.

On rotation axis 122 of intermediate gear G4, cleaning brush 116 is fixed to rotate in an anticlockwise direction shown by the figure along with rotation axis 112.

Gear G6 fixed on the other end of rotation axis 122 rotates gear G7 fixed on rotation axis 124 of second cleaning member 117. By rotating gear G7, second cleaning member 117 rotates in a clockwise direction shown by FIG. 2.

Holder 114 of first sheet feeding device 11 rotatably supports rotation axis 121, rotation axis 122 and second cleaning member 117, and fixes third cleaning member 118 and an end of shield member 119. An edge of third cleaning member 118 imposes the circumference surface of second cleaning member 117 in a counter direction. An edge of shield member 119 imposes the circumference surface of second cleaning member 117 in a trailing direction.

Holder 114 of first sheet feeding device 11 is supported so as to swing centering on rotation axis 121 of sheet feeding roller 112. When sheet is fed, engagement of an upper mechanism of first feeding device 11 composed of pickup roller 111, cleaning brush 116, second cleaning member 117, third cleaning member 118, shield member 119 and holder 114 is released and pickup roller 111 swings and press a top surface of S stored in sheet feeding cassette 10 at a predetermined pressure P1 so as to feed sheet S.

Since a cleaning device composed of cleaning brush 116, second cleaning member 117, third cleaning member 118 and shield member 119 is formed compact and light weight, it can maintain a predetermined pressure P1 and a minimum number of sheet S can be fed without fail, Cleaning brush 116 and second cleaning member 117 are provided in common for pickup roller 111 and sheet feeding roller 112 particularly to make first feeding device 11 light weight and compact. This way expands a possibility of design of first sheet feeding device 11 having a configuration where sheet S is sent out appropriately with a pressure of own weight.

Also, the foreign objects come from an obverse surface of sheet S and adhere to pickup surface and the foreign objects come from the obverse surface of sheet S and adhere to the surface of the feeding roller 112 can be completely cleaned by a cleaning device composed of cleaning brush 116, second cleaning member 117, third cleaning member 118 and shield member 119.

Also the foreign object which is from a reverse surface of sheet S and adheres to the surface of multiple feeding prevention roller 113 and the is further transferred to sheet feeding roller 112 can be cleaned completely by the cleaning device composed of cleaning brush 116, second cleaning member 117, third cleaning member 118 and shield member 119.

While, in the embodiment of the present invention, as the finishing apparatus connected with image forming apparatus main boy A, a finishing apparatus having a functions of side stitch have been explained, it is to be understood that application of the present invention is not limited to the finishing apparatus for the image forming apparatus thereof. It may be applied to finishing apparatuses for gumming bookbinding machine, edge cutting machine, glued-on cover casing-in machine and binding machine. The sheet feeding device of the present invention can be applied to any of finishing apparatus thereof.

Also in the embodiment of the present invention, while the finishing apparatus connected with the copying machine has been explained, the present invention is also applicable for an image forming systems connected with a shortrun printing machine, a printer, a facsimile machine and a multi function machine.

According to the aforesaid embodiment, it is possible to provide a sheet feeding device and an image forming apparatus using the device thereof in which removing of the foreign object such as the paper dust is possible for a long period of time and the foreign object to enter into the transfer area is reduced. Thus downsizing of the cleaning mechanism is realized and a high quality image can be obtained.

Further, there are obtained effects that the cleaning efficiency and the durability of the fist sheet feeding member and second sheet feeding member are improved, sheet conveyance performance of a sheet having paper dust is improved, and conveyance performance of a sheet printed by offset printing, in particular a coated sheet printed by offset printing is improved.

Also, owing to a structure where the first sheet feeding member and the second sheet feeding member are cleaned by one cleaning member, the sheet feeding device can be made compact compared to a structure where the cleaning members are provided respectively to each sheet feeding member.

What is claimed is:

1. A sheet feeding apparatus comprising:

a first sheet feeding member to press a surface of a sheet stored in a sheet storing section for sending out the sheet;

a second sheet feeding member arranged on a downstream side of the first sheet feeding member with respect to a sheet feeding direction to further convey the sheet from the first sheet feeding member downstream; and a first cleaning member rotatably supported in contact with both a circumference surface of the first feeding member and a circumference surface of the second feeding member to clean both the circumference surface of the first feeding member and the circumference surface of the second feeding member by rotation;

a second cleaning member in contact with the first cleaning member to clean the first cleaning member;

a third cleaning member in contact with the second cleaning member to clean the second cleaning member; and a shield member to shield a space above the first sheet feeding member, the second sheet feeding member, the first cleaning member and the second cleaning member;

wherein an edge of the shield member contacts the second cleaning member with a pressure less than a pressure by which the third cleaning member contacts the second cleaning member.

2. The sheet feeding apparatus of claim 1 wherein the third cleaning member and the shield member are formed respectively with a flexible thin plate.

3. The sheet feeding apparatus of claim 1, wherein an edge of the third cleaning member contacts a circumference surface of the second cleaning member in a counter direction to a rotation direction of the second cleaning member.

4. The sheet feeding apparatus of claim 1, wherein an edge of the shield member contacts a circumference surface of the second cleaning member in a trailing direction to a rotation direction of the second cleaning member.

5. An image forming apparatus, comprising:

a sheet feeding apparatus comprising:

a first sheet feeding member to press a surface of a sheet stored in a sheet storing section for sending out the sheet;

a second sheet feeding member arranged on a downstream side of the first sheet feeding member with respect to a sheet feeding direction to further convey the sheet from the first sheet feeding member downstream; and a first cleaning member rotatably supported in contact with both a circumference surface of the first feeding member and a circumference surface of the second feeding member to clean both the circumference surface of the first feeding member and the circumference surface of the second feeding member by rotation;

a second cleaning member in contact with the first cleaning member to clean the first cleaning member;

a third cleaning member in contact with the second cleaning member to clean the second cleaning member; and a shield member to shield a space above the first sheet feeding member, the second sheet feeding member, the first cleaning member and the second cleaning member;

wherein an edge of the shield member contacts the second cleaning member with a pressure less than a pressure by which the third cleaning member contacts the second cleaning member; and an image forming section to form an image on the sheet fed from the sheet feeding apparatus thereof.

* * * * *